US006412730B1

(12) United States Patent
Shimazaki

(10) Patent No.: US 6,412,730 B1
(45) Date of Patent: Jul. 2, 2002

(54) DEVICE AND METHOD FOR STORING ELONGATED PLASTICALLY DEFORMABLE MEMBER

(75) Inventor: Nobuyoshi Shimazaki, Tokyo (JP)

(73) Assignee: Bridgestone Corporation, Tokyo (JP)

( * ) Notice: Subject to any disclaimer, the term of this patent is extended or adjusted under 35 U.S.C. 154(b) by 5 days.

(21) Appl. No.: 09/589,074

(22) Filed: Jun. 8, 2000

(30) Foreign Application Priority Data

Jun. 8, 1999 (JP) ..... 11-161071
Apr. 21, 2000 (JP) ..... 2000-121141

(51) Int. Cl.[7] ..... B65H 75/18

(52) U.S. Cl. ..... 242/602; 242/540; 242/559.4; 242/533.3; 156/405.1

(58) Field of Search ..... 242/602, 528, 242/393, 540, 595.1, 533.3, 559.4; 156/405.1, 406.4

(56) References Cited

U.S. PATENT DOCUMENTS 3,674,222 A * 7/1972 Smiley
4,705,227 A * 11/1987 Honegger
4,741,487 A * 5/1988 Balass
4,757,952 A * 7/1988 Balzer
4,934,620 A * 6/1990 Rossi
5,116,043 A * 5/1992 Jermann et al.
5,176,333 A * 1/1993 Stauber
5,364,490 A * 11/1994 Hilke et al. ..... 156/405.1
5,673,869 A * 10/1997 Honegger
5,762,740 A * 6/1998 Benzing et al. ..... 156/406.4
6,126,780 A * 10/2000 Benzing et al. ..... 156/406.4

* cited by examiner

*Primary Examiner*—William A. Rivera
(74) *Attorney, Agent, or Firm*—Sughrue Mion, PLLC

(57) ABSTRACT

A device and a method for storing an elongated plastically deformable member are provided in which, even if an elongated plastically deformable member and a liner are stored in a state of being superposed together and wound on a take-up reel, deformation of portions of the elongated plastically deformable member and non-uniformity of deformation of the elongated plastically deformable member can be suppressed. When a liner and an unvulcanized tread member are taken-up on and stored on a reel, the reel is supported by a driven roller and a drive roller, and the reel is stored in a state of being rotated constantly. As a result, during storage, a load caused by the wound tread member itself is applied uniformly to an entire wound circumference. Therefore, collapsing deformation caused thereby is made uniform along a longitudinal direction, and differences in a configuration of the tread member at respective wound layers do not arise.

19 Claims, 15 Drawing Sheets

DEVICE AND METHOD FOR STORING ELONGATED PLASTICALLY DEFORMABLE MEMBER

BACKGROUND OF THE INVENTION

1. Field of the Invention

The present invention relates to a device and a method for storing an elongated plastically deformable member which use a take-up reel on which an elongated plastically deformable member is taken-up in a state of being superposed together with a liner.

2. Description of the Related Art

Conventionally, in order to store unvulcanized, green rubber used for the tread or the sidewalls or the like of a tire, there are methods in which an elongated green rubber member, which is extruded from an extruder and has a constant cross-sectional configuration, is stored in a state of being taken-up (wound) on a reel.

At this time, because the green rubber is tacky, if it is taken-up as is, the outer side of one layer of the wound green rubber sticks to the inner side of another layer of the wound green rubber.

As a result, generally, the green rubber member extruded from the extruder is taken-up in layers via a liner. That is, the liner is disposed between the respective wound layers of the green rubber, which prevents the layers from sticking to one another.

Generally, because an unvulcanized, green rubber is plastic, it tends to deform when mechanical stress is applied thereto. When the green rubber is taken-up together with the liner, the configuration of the green rubber deforms due to the tension of the liner and the weight of the green rubber itself.

In particular, the deformation caused by the weight of the green rubber itself which is rolled in layers is great. Such deformation in the green rubber causes troubles in molding in a later process, and the uniformity of obtained products is markedly poor.

Thus, as illustrated in FIG. 15, an elongated member storing device has been proposed in which a spacer 102 is mounted to and integral with either end of a liner 103. A space d is formed between the outer side portion of a green rubber member 101, which is taken-up onto the reel via the liner 103, and the inner side portion of the liner 103, so as to prevent deformation of the green rubber member 101.

Further as illustrated in FIG. 16, an elongated member storing device has been proposed in which receiving members 204, 205 are provided, along a swirled line having a standard interval k around a center axis C of the reel, at opposing sides of a pair of opposing rotating members 202, 203. Due to the receiving members 204, 205, an elongated member 201 is wound via a liner 206, and a space d is formed between the outer side portion of the wound elongated member 201 and the inner side portion of the liner 206. In this way, plastic deformation of the green rubber product can be prevented.

In the device in which the spacers 102 are made integral at the both ends of the liner 103 (see FIG. 15) and the device provided with the pair of receiving members 204, 205 disposed along a swirled line having standard intervals between respective wound layers (see FIG. 16), plastic deformation of the green rubber product is prevented due to the space d being formed between the outer side portion of the wound elongated product and the inner side portion of the liner.

There are green rubber products of various different thicknesses, and thus, in the above-described storing devices illustrated in FIGS. 15 and 16, the spiral interval d is determined on the basis of the thickest green rubber product.

As a result, when a thinner green rubber member is wound, the interval d is large and the wound length of the green rubber member is short, and thus, the winding efficiency is poor.

In order to overcome this problem, a plurality of types of liners 103 whose spacers 102 have different thicknesses may be readied, or a plurality of types of devices having different spiral intervals d may be readied. However, this results in drawbacks such as increased costs and poor efficiency of use.

SUMMARY OF THE INVENTION

In view of the aforementioned, an object of the present invention is to provide a device and a method for storing an elongated plastically deformable member in which, even if an elongated plastically deformable member such as green rubber or the like is stored in a state of being wound in superposed layers, deformation of portions of the elongated plastically deformable member and non-uniform deformation of the elongated plastically deformable member can be suppressed.

In order to achieve the above object, a first aspect of the present invention is a device for use in storing an elongated plastically deformable member wound on a take-up reel with a thin-plate-shaped liner superposed with the elongated plastically deformable member, the take-up reel having an axis which is substantially horizontal, the device comprising a rotating means adapted to rotate the take-up reel at least one of constantly and intermittently.

Further, a method of the present invention for storing an elongated plastically deformable member wound on a take-up reel together with a thin-plate-shaped liner superposed with the elongated plastically deformable member, the take-up reel having an axis which is substantially horizontal, comprises the step of rotating the take-up reel at least one of constantly and intermittently.

In this first aspect of the present invention, when a take-up reel, on whose outer peripheral surface are wound a superposed thin-plate-shaped liner and an elongated plastically deformable member, is set in a state in which the axis of the take-up reel is substantially horizontal with respect to a setting surface, the take-up reel is rotated at least one of constantly or intermittently by the rotating means.

Because the take-up reel is rotated constantly or intermittently, during storing, the load of the wound elongated plastically deformable member itself is applied uniformly to the entire wound circumference and does not concentrate at particular portions, even after time passes. Therefore, collapsing deformation caused thereby is made uniform along the longitudinal direction, and differences in a configuration of the elongated plastically deformable member between the respective wound layers do not arise.

Here, "always rotated" or "constantly rotated" means "continuously rotated", but may include stopping for an instant such as when reversing rotation (a period of time in which configurational differences which adversely affect the uniformity of the product are not caused between the respective wound layers of the elongated plastically deformable member; this time varies in accordance with the wound amount, the flexibility, and the like of the elongated plastically deformable member).

In a second aspect of the present invention, in the device for use in storing an elongated plastically deformable member according to the first aspect, the rotating means rotates the take-up reel over a given angle in a first direction of rotation, and thereafter, the rotating mechanism rotates the take-up reel in another direction, and alternately repeats rotating in said first direction and said another direction of rotation.

Further, a method of the present invention for storing an elongated plastically deformable member wound on a take-up reel together with a thin-plate-shaped liner superposed with the elongated plastically deformable member, the take-up reel having an axis which is substantially horizontal, comprises the step of rotating the take-up reel at least one of constantly and intermittently.

The member which is being taken-up and stored with the liner is an elongated plastically deformable member such as a green rubber product. An unvulcanized green rubber is plastic, and is easily deformed when mechanical stress is applied thereto. Therefore, if, during storage, the take-up reel is continuously rotated in the same direction as the direction in which the green rubber product is wound, the winding of the wound green rubber product will tighten. If the take-up reel is continuously rotated in the direction opposite the direction in which the green rubber product is wound, the winding of the wound green rubber product will loosen.

In accordance with the present aspect, after the take-up reel is rotated over a given angle, the direction of rotation is changed, and this rotation and changing of the direction of rotation are repeated. Therefore, tightening of the winding or loosening of the winding of the elongated plastically deformable member taken-up on the take-up reel can be prevented.

Here, it is preferable that the given angle is 180° or an integer multiple of 180°.

In a third aspect of the present invention, in the device for storing an elongated plastically deformable member, the rotating means has pair of rollers which abut the take-up reel.

In the present aspect, the take-up reel is disposed on the pair of rollers, and by rotating the rollers, the take-up reel is rotated.

In a fourth aspect, one roller of the pair of rollers is a drive roller connected to a rotating driving means, and the other roller is a driven roller.

In accordance with the present aspect, the drive roller is rotated by the rotating driving means, and the take-up reel is thereby rotated. Due to the rotation of the take-up reel, the driven roller abutting the reel rotates.

In a fifth aspect of the present invention, the driven roller is connected to a moving means, and when the driven roller is moved from a first position to a second position, the take-up reel is raised up off of the setting surface by the driven roller and the drive roller.

In accordance with the present aspect, the driven roller is provided so as to be able to be moved by the moving means. When the driven roller is positioned at the first position, the take-up reel is disposed on the setting surface. As a result, the take-up reel can be loaded in and removed from the device for storing an elongated plastically deformable member by being rolled on the setting surface. At the next stage, when the take-up reel is disposed between the driven roller and the drive roller, the driven roller is moved from the first position to the second position and the take-up reel is raised up off of the setting surface by the driven roller and the drive roller. As a result, the take-up reel is supported and rotated by the driven roller and the drive roller.

In a sixth aspect of the present invention, the driven roller is removably provided.

In accordance with the present aspect, if the driven roller gets in the way when the take-up reel is attached or removed, the driven roller is removed, so that the work of attaching or removing the take-up reel is facilitated.

DESCRIPTION OF THE PREFERRED EMBODIMENTS

First Embodiment

A first embodiment of the present invention will be described hereinafter with reference to the drawings.

Figure 4:
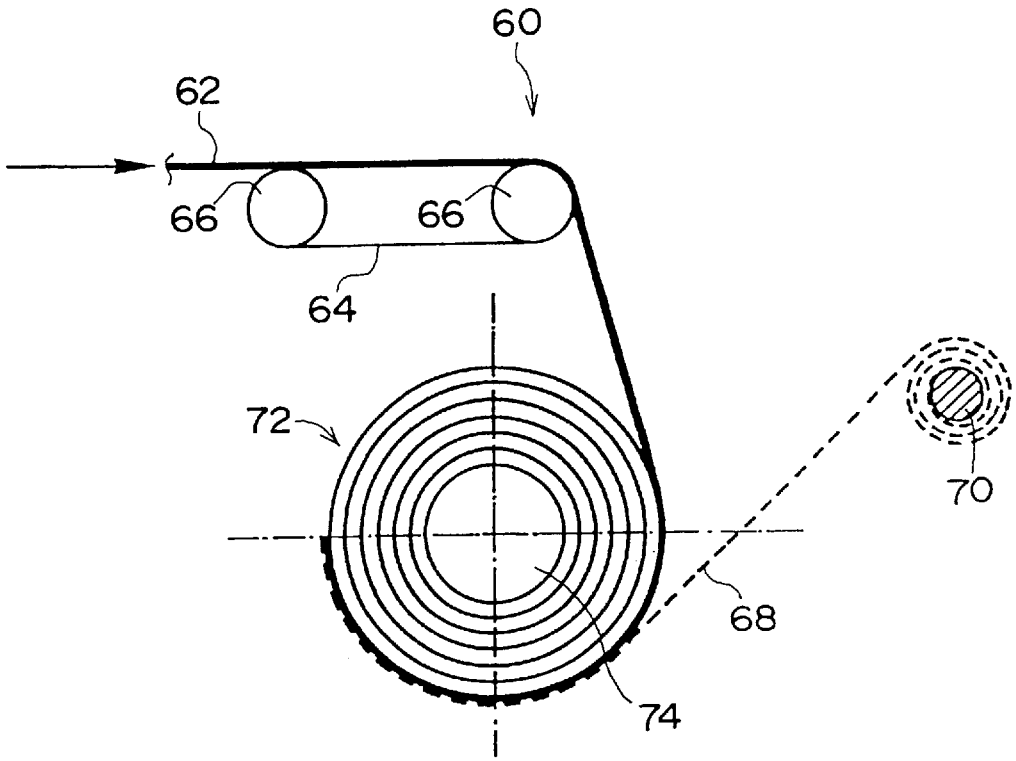
FIG. 4 is a schematic structural view of a tread member take-up device.

FIG. 4 is a schematic illustration of, as an example, a tread member take-up device 60 for taking-up an unvulcanized tread member used in manufacturing a tire.

The tread member take-up device 60 includes a conveying belt 64 for conveying an unvulcanized tread member 62 which has been extruded from an extruder (not shown), conveying rollers 66 around which the conveying belt 64 is trained, a roller 70 for supplying a liner 68 which is formed from synthetic resin or the like, and a rotating shaft 74 which supports a reel 72 for taking-up the tread member 62 via the liner 68.

Figure 3:
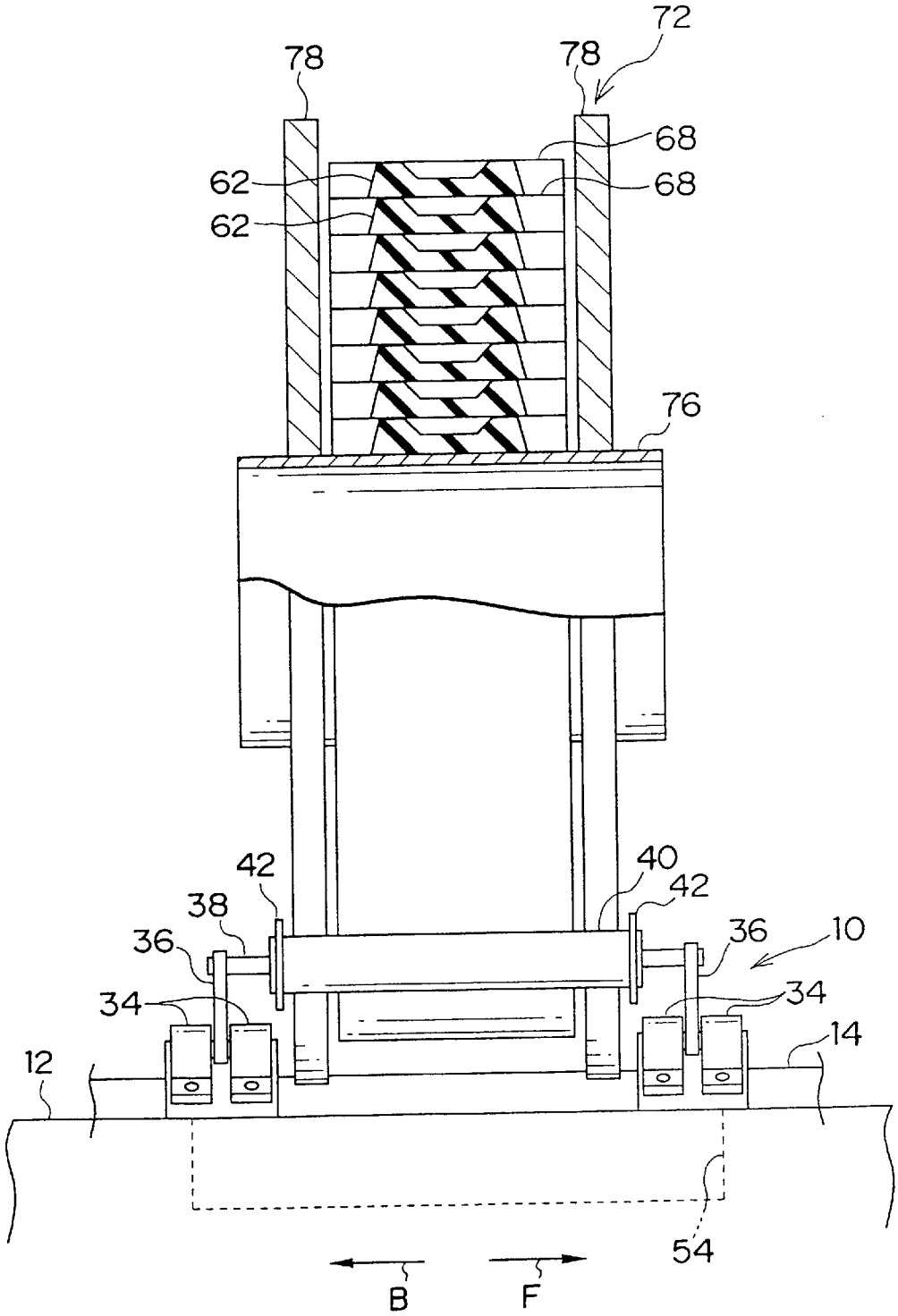
FIG. 3 is a front view of the device for storing an elongated plastically deformable member relating to the first embodiment of the present invention.

As illustrated in FIG. 3, the reel 72 has a flange 78 at either end of a drum 76 which takes-up the tread member 62.

The tread member 62, which is extruded out from the extruder, is conveyed by the conveying belt 64, and is taken-up by the reel 72.

At this time, the liner 68 which is wound around the roller 70 is also taken-up by the reel 72. Thus, the tread member 62 is taken-up in a state of being adhered to the liner 68 due to the tackiness of the tread member 62. As a result, respective layers of the wound tread member 62 do not stick to one another.

As illustrated in FIG. 3, usually, the cross-sectional configuration of the tread member 62 is a so-called contour configuration in which a recess is formed in the central portion and both sides thereof project. When the tread member 62 is taken-up and stored, collapsing of this counter configuration must be suppressed.

Next, a storing device 10 for storing the reel 72 on which the tread member 62 is wound will be described.

Figure 1:
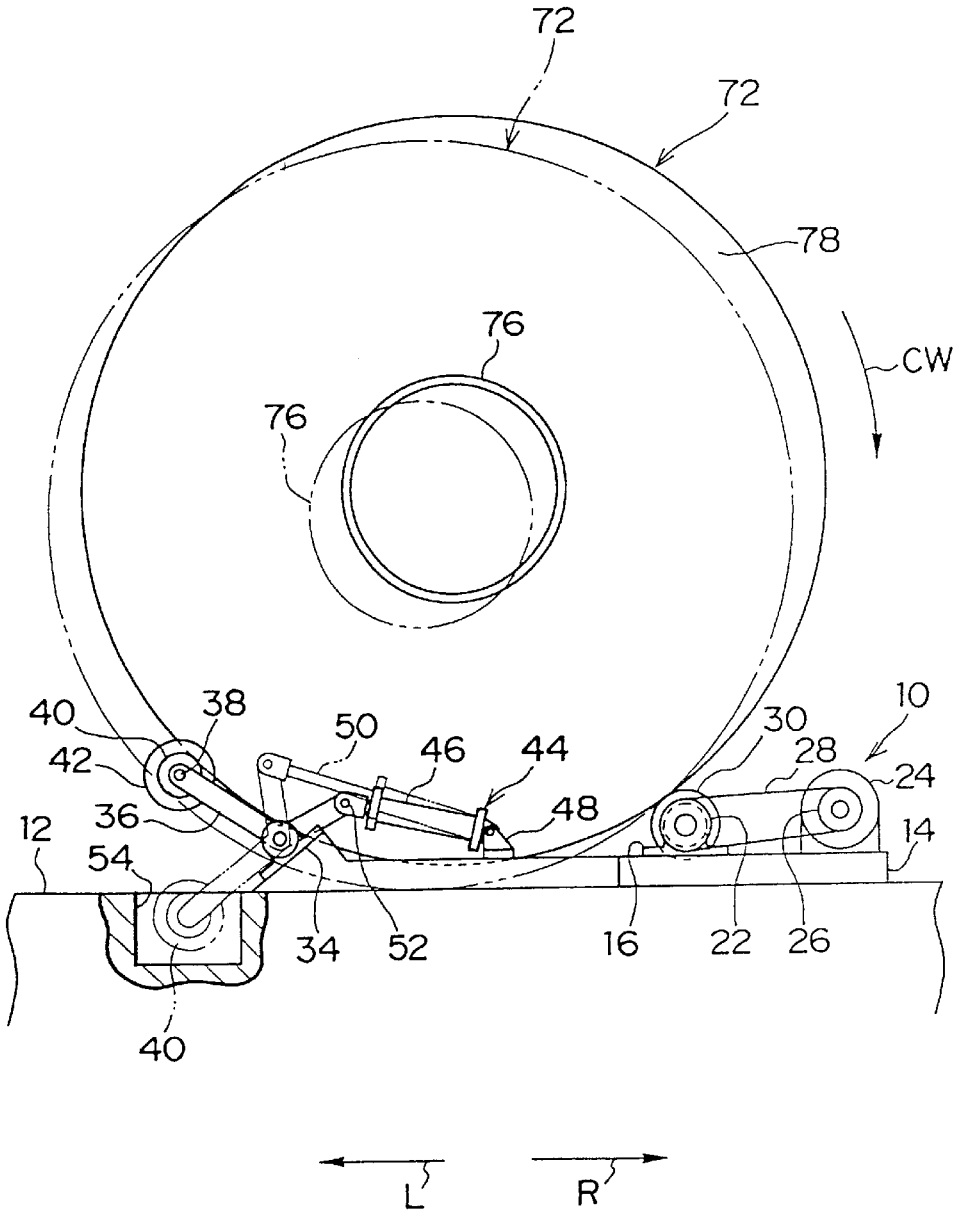
FIG. 1 is a side view of a device for storing an elongated plastically deformable member relating to a first embodiment of the present invention.
Figure 2:
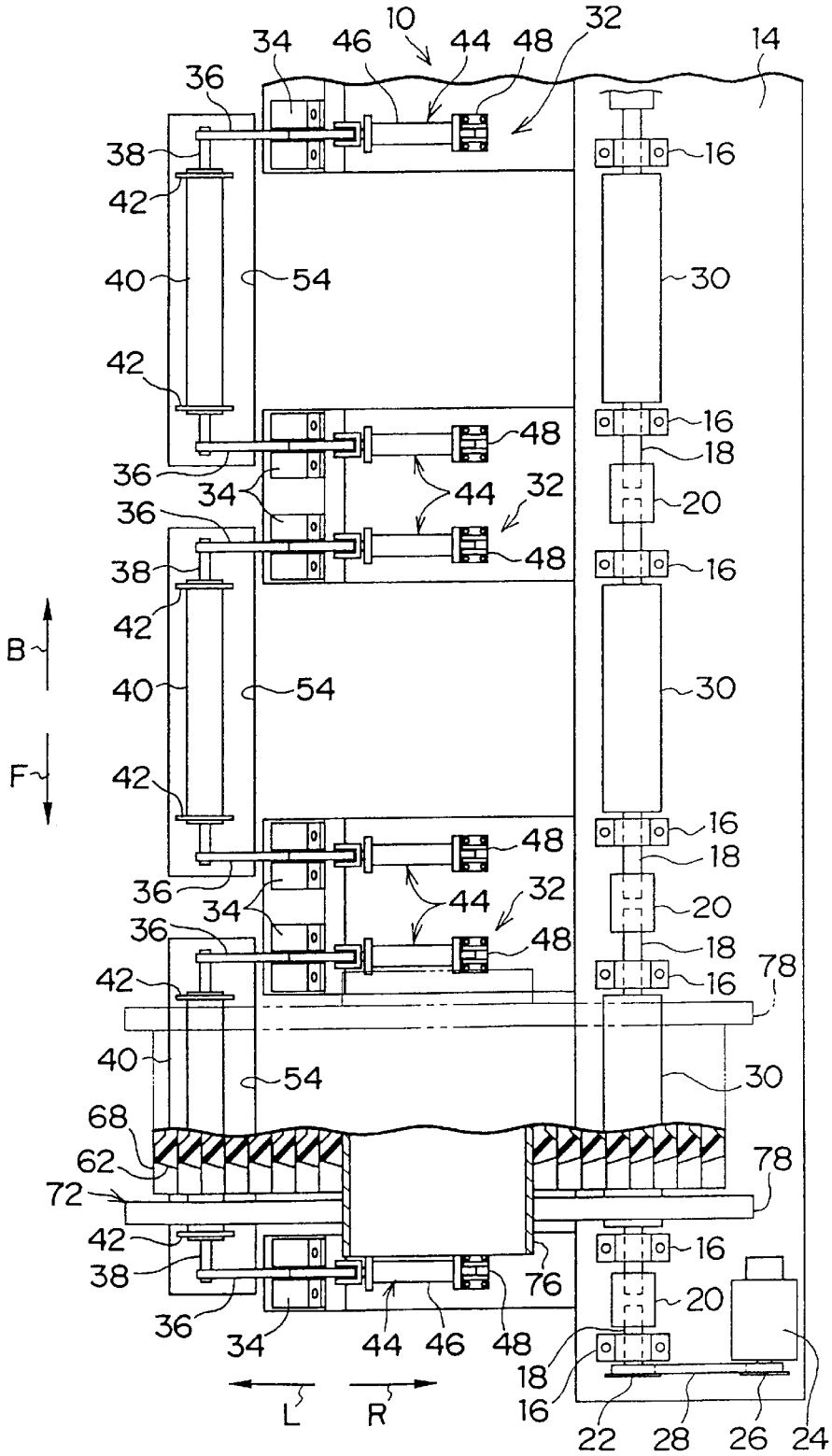
FIG. 2 is a plan view of the device for storing an elongated plastically deformable member relating to the first embodiment of the present invention.

As shown in FIGS. 1 through 3, the storing device 10 includes a frame 14 on a setting surface 12.

A plurality of shaft supporting portions 16 are mounted to the arrow R direction side of the frame 14 along the directions of arrows F and B. Shafts 18 are supported so as to be freely rotatable by the shaft supporting portions 16. The shafts 18 are connected to one another by couplings 20.

A pulley 22 is mounted to the shaft 18 at the arrow F direction side.

A motor 24 is attached to the frame 14, and a pulley 26 is attached to the shaft of the motor 24.

A belt 28 is trained around the pulley 22 and the pulley 26. Due to the driving of a motor 24, the shafts 18 rotate.

Drive rollers 30 are attached to the shafts 18.

A moving roller device 32 is provided at the arrow L direction side of each drive roller 30.

The moving roller device 32 includes a pair of shaft supporting portions 34 at the arrow L direction side of the frame 14. Substantially L-shaped links 36 are rotatably supported at these shaft supporting portions 34.

The arrow L direction side end of one link 36 is connected to the arrow L direction side end of another link 36 by a shaft 38. A driven roller 40 is supported at the shaft 38 so as to be freely rotatable.

A flange 42 is attached to each end portion of the driven roller 40. The flanges 42 are disposed at the outer sides of the flanges 78 of the reel 72, and function to restrict axial direction movement of the reel 72.

An air cylinder 44 is provided at the arrow R direction side of the shaft supporting portion 34.

A cylinder main body 46 of the air cylinder 44 is supported so as to be freely swingable at a shaft supporting portion 48 provided at the frame 14.

The arrow R direction side end of the link 36 is connected to a piston rod 50 of the air cylinder 44 via a pin 52.

When the piston rods 50 of the air cylinders 44 are extended, the links 36 rotate counterclockwise, and the driven rollers 40 enter into concave portions 54 provided at the setting surface 12, as illustrated by the two-dot chain line in FIG. 1. (This is the first state of the present invention.)

Further, when the piston rods 50 of the air cylinders 44 are pulled in, as illustrated by the solid lines in FIG. 1, the links 36 rotate clockwise, and the driven rollers 40 are positioned a predetermined dimension above the setting surface 12. (This is the second state of the present invention.)

Here, when the reel 72 is placed on the drive roller 30 and the driven roller 40 in a state in which the driven roller 40 is positioned a predetermined dimension above the setting surface 12, the bottom end of the reel 72 is positioned above the setting surface 12 such that the reel 72 is supported by the drive roller 30 and the driven roller 40.

In the state in which the driven roller 40 has entered into the concave portion 54, the bottom end of the reel 72 abuts the setting surface 12, and the reel 72 can be rolled on the setting surface 12.

Next, operation of the storing device 10 of the present first embodiment will be described.

First, the tread member 62 formed by being extrusion molded from the extruder (not shown) is conveyed by the conveying belt 64 and, together with the liner 68, is taken-up onto the reel 72.

When the winding of a predetermined length of the tread member 62 has been completed, the reel 72 is removed from the rotating shaft 74, and is taken to the storing device 10 by being rolled on the setting surface 12 or the like.

In the storing device 10, first, as shown by the two-dot chain line in FIG. 1, the driven roller 40 is set in a state of being entered into the concave portion 54 (the first state of the present invention), and the reel 72 is rolled from the arrow L direction side toward the arrow R direction side in FIG. 1 so as to abut the drive roller 30.

Next, the piston rods 50 of the air cylinders 44 are retracted so that the links 36 are rotated in the clockwise direction. In this way, the driven roller 40 rises (the second state of the present invention), and the reel 72 is raised up so as to be separated from the setting surface 12 and so as to be supported by the drive roller 30 and the driven roller 40.

Thereafter, the motor 24 is rotated, and the reel 72 is rotated at slow speed, for example, 180° clockwise (in the direction of arrow CW). After being rotated 180° clockwise, the direction of rotation is changed and the reel 72 is rotated 180° counterclockwise. After the reel 72 is rotated 180° counterclockwise, the direction of rotation is again changed, and the same opposite operations are repeated until the tread member 62 is to be used.

While the tread member 62 is being stored, the load caused by the wound tread member 62 itself is applied uniformly along the entire wound circumference in accordance with the rotation of the reel 72. Thus, collapsing deformation of the tread member 62 caused by the load of the wound tread member 62 itself is made uniform along the entire longitudinal direction, such that no difference in configuration arises between the respective wound layers.

Accordingly, because the gauge within one tread which is molded as a tire is uniform along the longitudinal direction, there are no effects on uniformity.

Further, the take-up reel 72 is not rotated continuously in one direction. After the reel 72 is rotated 180°, the direction of rotation is changed. By repeating these operations, tightening up of the winding or loosening of the winding of the reel member 62 can be prevented.

By making the rotational speed slow, the setting and removal of the take-up reel 72 can be carried out safely even if the rotation of the driving rollers 30 is not stopped.

Further, the reel 72 does not have to be rotated constantly, and forward rotation and reverse rotation may be repeated intermittently.

An amount of rotation of the take-up reel 72 which is sufficient for making the deformation of the protruding portions of the tread member 62, caused by the pressing of the weight of the tread member 62 itself, uniform throughout the respective wound layers is an integer multiple of 180°. Accordingly, after the reel 72 is rotated 360° (one rotation) for example, the rotational direction may be changed, and these operations may be repeated.

Here, a more preferable condition for operating the storing device 10 is that, each time the take-up reel is rotated 180° at a slow rotational speed, the rotational direction is changed. Here, "slow rotational speed" means a speed which is less than or equal to one-half of a rotation per minute.

Using a tire for a regular passenger vehicle as an example, the range of thicknesses of the thickest portions of treads of various sizes is usually 8 to 15 mm. In conventional methods, the winding interval is set to 15 mm or more in order to obtain a gap d between the liner and the tread. However, by using the present method, winding is carried out by using a generally used method. Thus, comparing the present invention with the conventional methods, in the case of a tread member having a relatively thin thickness of around 8 mm, the present invention allows a length of the tread member 62 which is 1.8 times that in the conventional art to be wound around the take-up reel 72. In the case of a tread member having an average thickness of about 10 mm, the present invention allows a length of the tread member 62 which is about 1.5 times or less that in the conventional art to be wound around the take-up reel 72.

As a result, the number of reels 72 and the amount of the liner 68 held can be made about ⅔ of that in the conventional art.

Second Embodiment

A second embodiment of the present invention will be described hereinafter with reference to FIGS. 5 and 6. Structures which are the same as those of the above-described embodiment are denoted by the same reference numerals, and description thereof will be omitted.

Figure 5A:
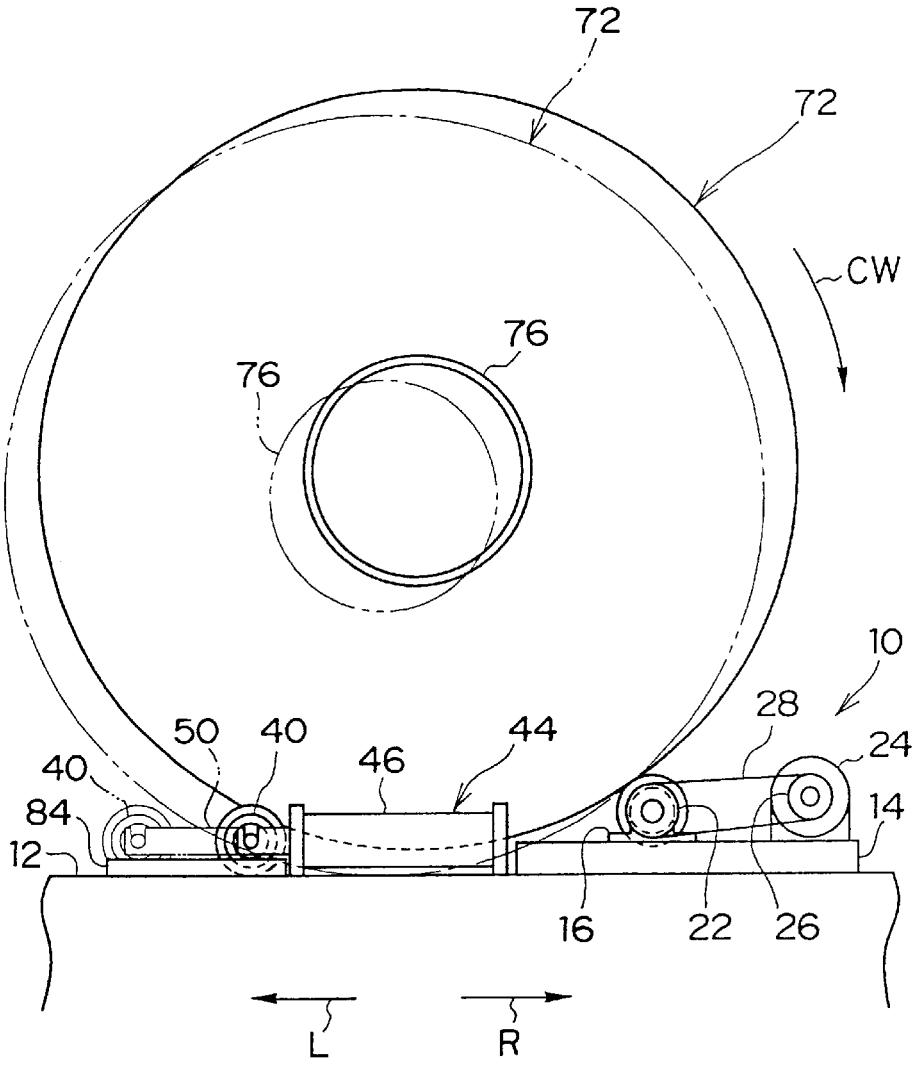
FIG. 5A is a side view of a device for storing an elongated plastically deformable member relating to a second embodiment of the present invention.
Figure 5B:
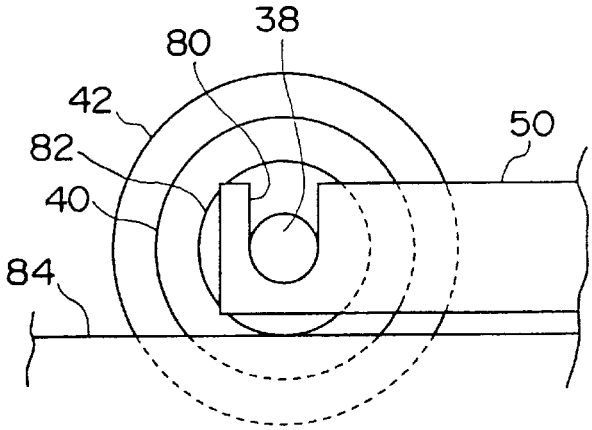
FIG. 5B is a side view of a vicinity of a driven roller relating to the second embodiment of the present invention.
Figure 6:
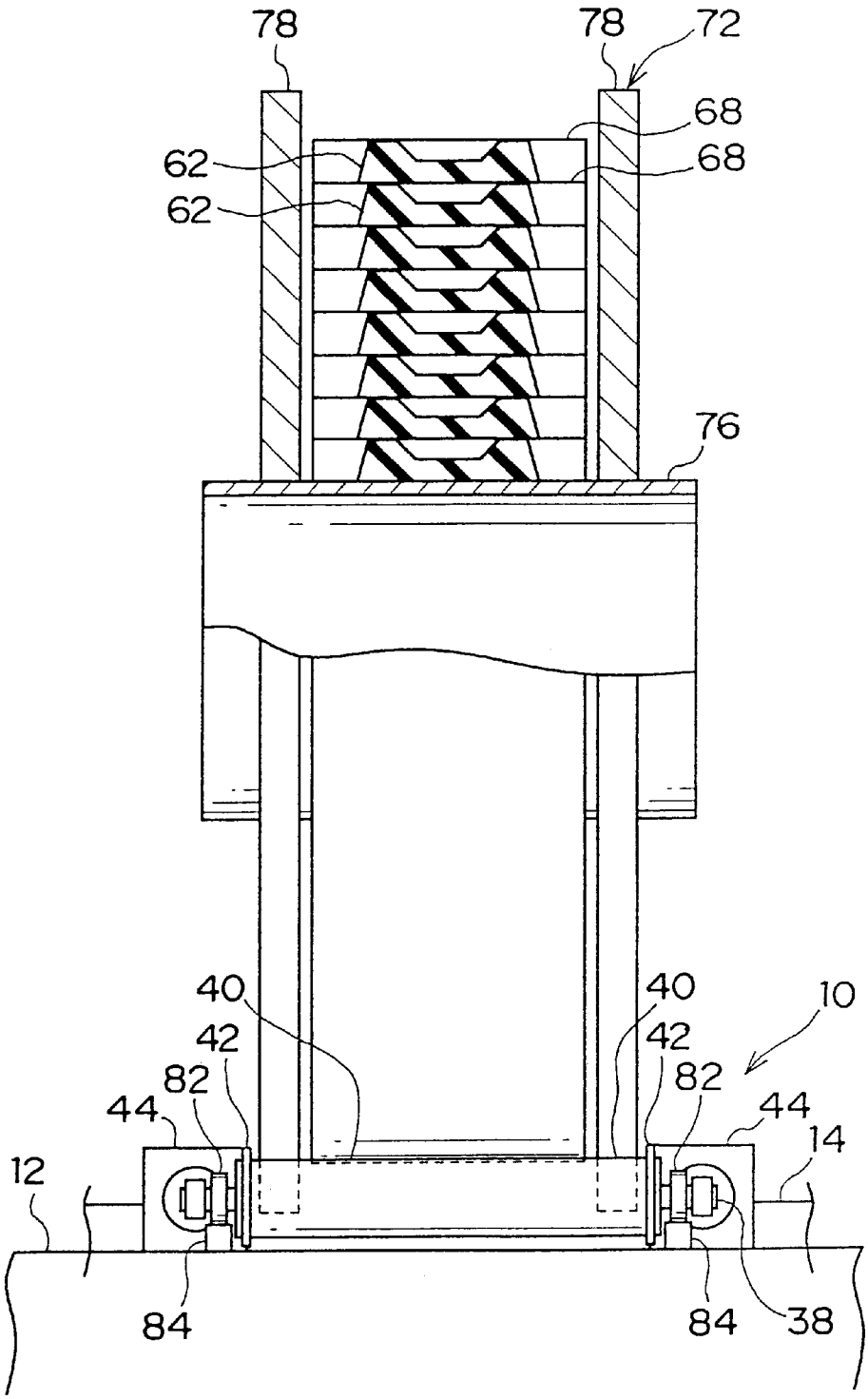
FIG. 6 is a front view of the device for storing an elongated plastically deformable member relating to the second embodiment of the present invention.

As illustrated in FIGS. 5 and 6, in the present second embodiment, the air cylinders 44 are disposed horizontally at the setting surface 12.

A substantially U-shaped notch 80 is formed in the distal end of the piston rod 50. The shaft 38 at which the driven roller 40 is provided can be inserted into the notch 80. One end side of the shaft 38 is inserted into the notch 80 of the piston rod 50 of one air cylinder 44, whereas the other end of the shaft 38 is inserted into the notch 80 of the piston rod 50 of another air cylinder 44.

Small rollers 82 are rotatably supported at the shaft 38 at the sides of the driven roller 40. The small rollers 82 are disposed on rails 84 provided at the setting surface 12, and support the load of the take-up reel 72 applied to the driven roller 40.

Next, operation of the storing device 10 of the present second embodiment will be described.

In the present second embodiment, first, as illustrated by the two-dot chain line in FIG. 5A, the piston rods 50 of the air cylinders 44 are extended (the first state of the present invention), and in a state in which the driven roller 40 is apart from the piston rods 50, the reel 72 is rolled and is made to abut the drive roller 30.

Next, the driven roller 40 is attached to the piston rods 50, and the piston rods 50 of the air cylinders 44 are retracted (the second state of the present invention).

In this way, the driven roller 40 abuts the flanges 78, and as illustrated by the solid lines in FIG. 5A, the reel 72 is raised up, moves apart from the setting surface 12, and is supported by the drive roller 30 and the driven roller 40.

Thereafter, the reel 72 is rotated and stored in the same way as in the first embodiment.

The effects of the present embodiment are the same as those of the first embodiment.

Third Embodiment

A third embodiment of the present invention will be described hereinafter with reference to FIGS. 7 and 8. In the present storing device, structures which are the same as those of the above-described embodiments are denoted by the same reference numerals, and description thereof will be omitted.

Figure 7:
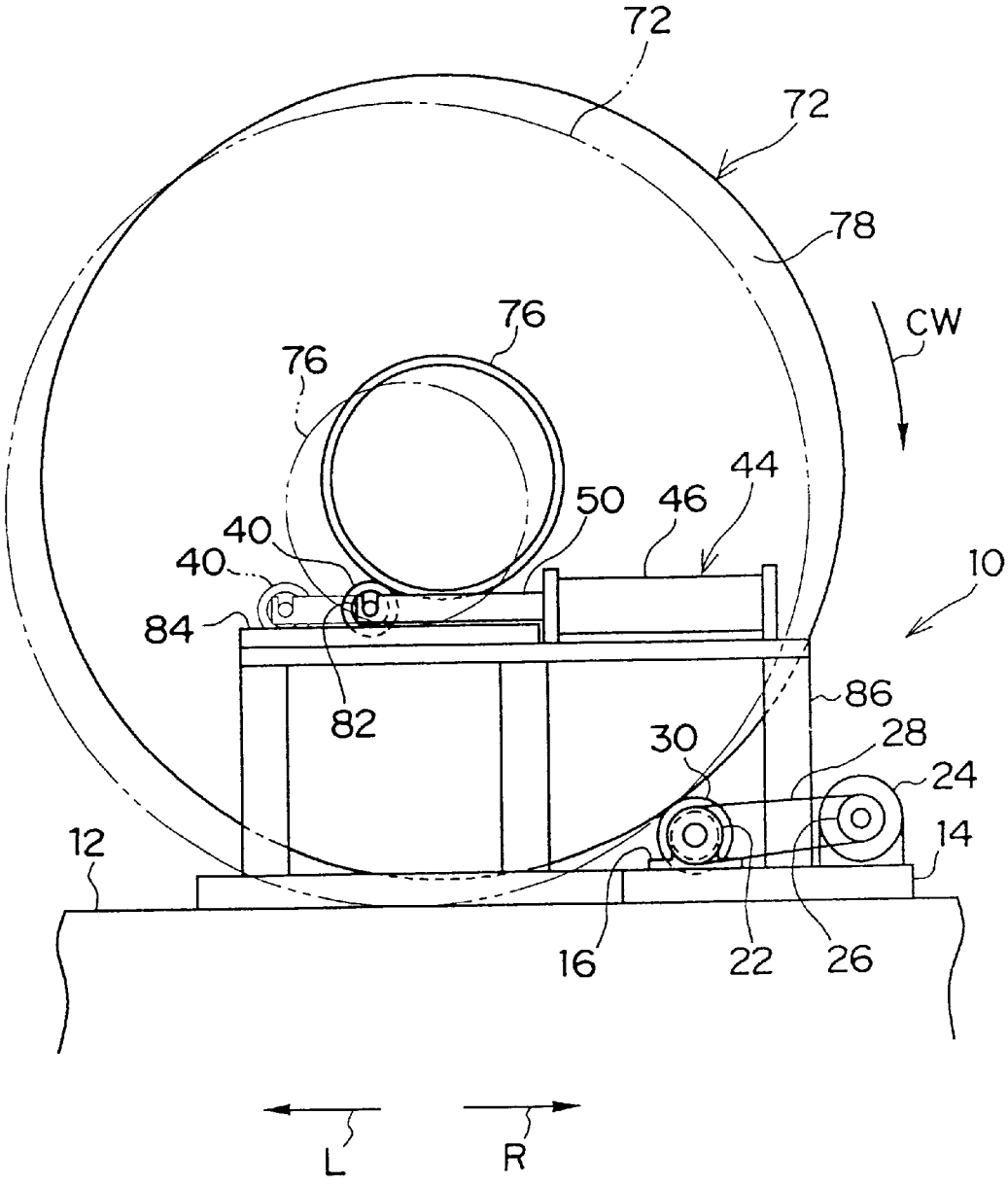
FIG. 7 is a side view of a device for storing an elongated plastically deformable member relating to a third embodiment of the present invention.
Figure 8:
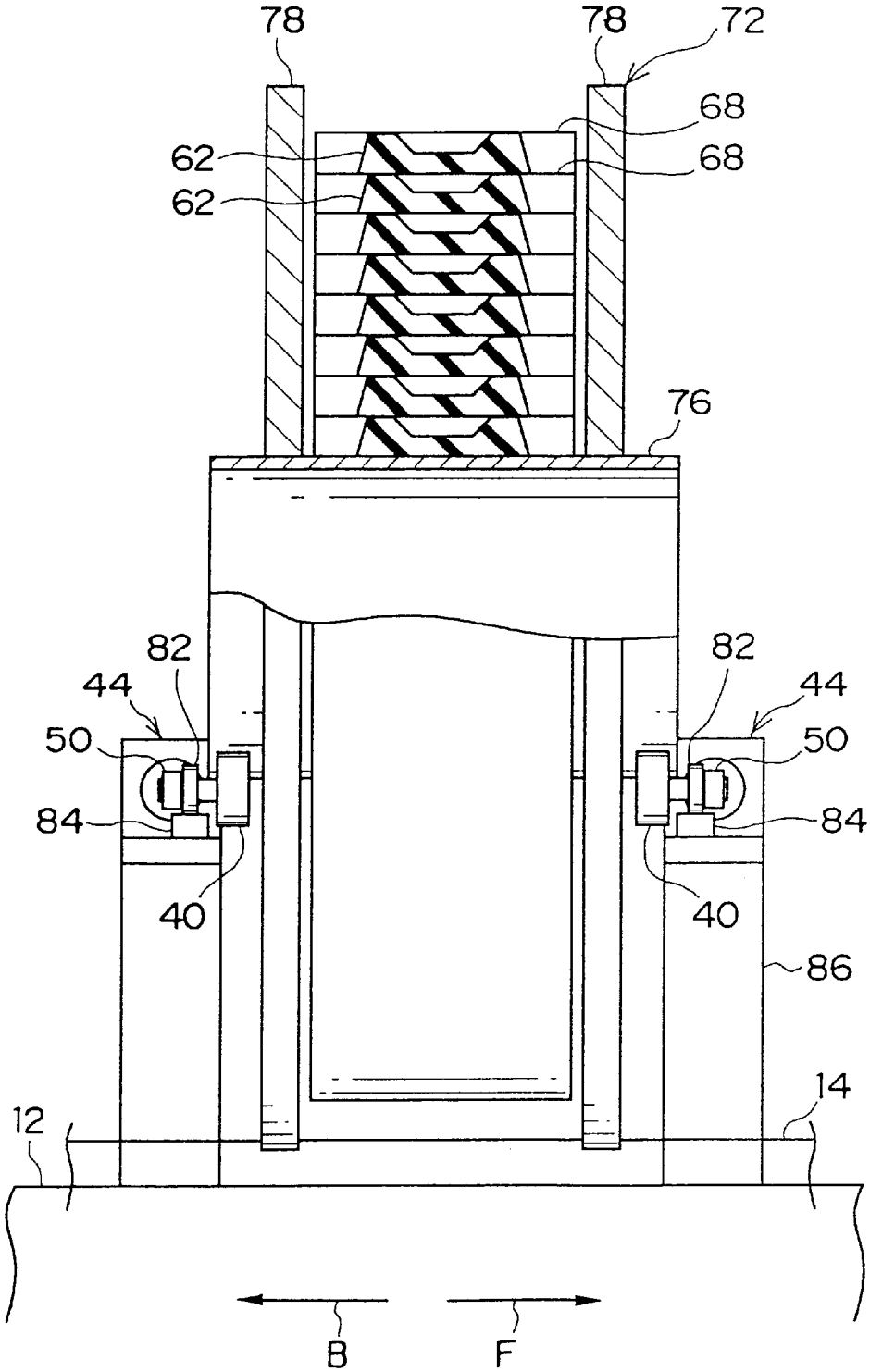
FIG. 8 is a front view of the device for storing an elongated plastically deformable member relating to the third embodiment of the present invention.

As illustrated in FIGS. 7 and 8, in the present third embodiment, the air cylinders 44 and the rails 84, which are similar to those of the second embodiment, are supported horizontally on the top portions of supporting columns 86.

Next, operation of the storing device 10 of the present third embodiment will be described.

In the present third embodiment, first, as illustrated by the two-dot chain lines in FIG. 7, the piston rods 50 of the air cylinders 44 are extended (the first state of the present invention), and in a state in which the driven roller 40 is away from the piston rods 50, the reel 72 is rolled and made to abut the drive roller 30.

Next, the driven roller 40 is attached to the piston rods 50, and the piston rods 50 of the air cylinders 44 are retracted (the second state of the present invention).

In this way, the drive roller 40 abuts the drum 76, and as illustrated by the solid lines in FIG. 7, the reel 72 is raised up, moves apart from the setting surface 12, and is supported by the drive roller 30 and the driven roller 40.

Thereafter, in the same way as the previously-described embodiments, the reel 72 is rotated and stored.

The effects of the present third embodiment are the same as those of the previously-described embodiments.

Fourth Embodiment

A fourth embodiment of the present invention will be described hereinafter with reference to FIGS. 9 and 10. Structures which are the same as those of the above-described embodiments are denoted by the same reference numerals, and description thereof will be omitted.

Figure 9:
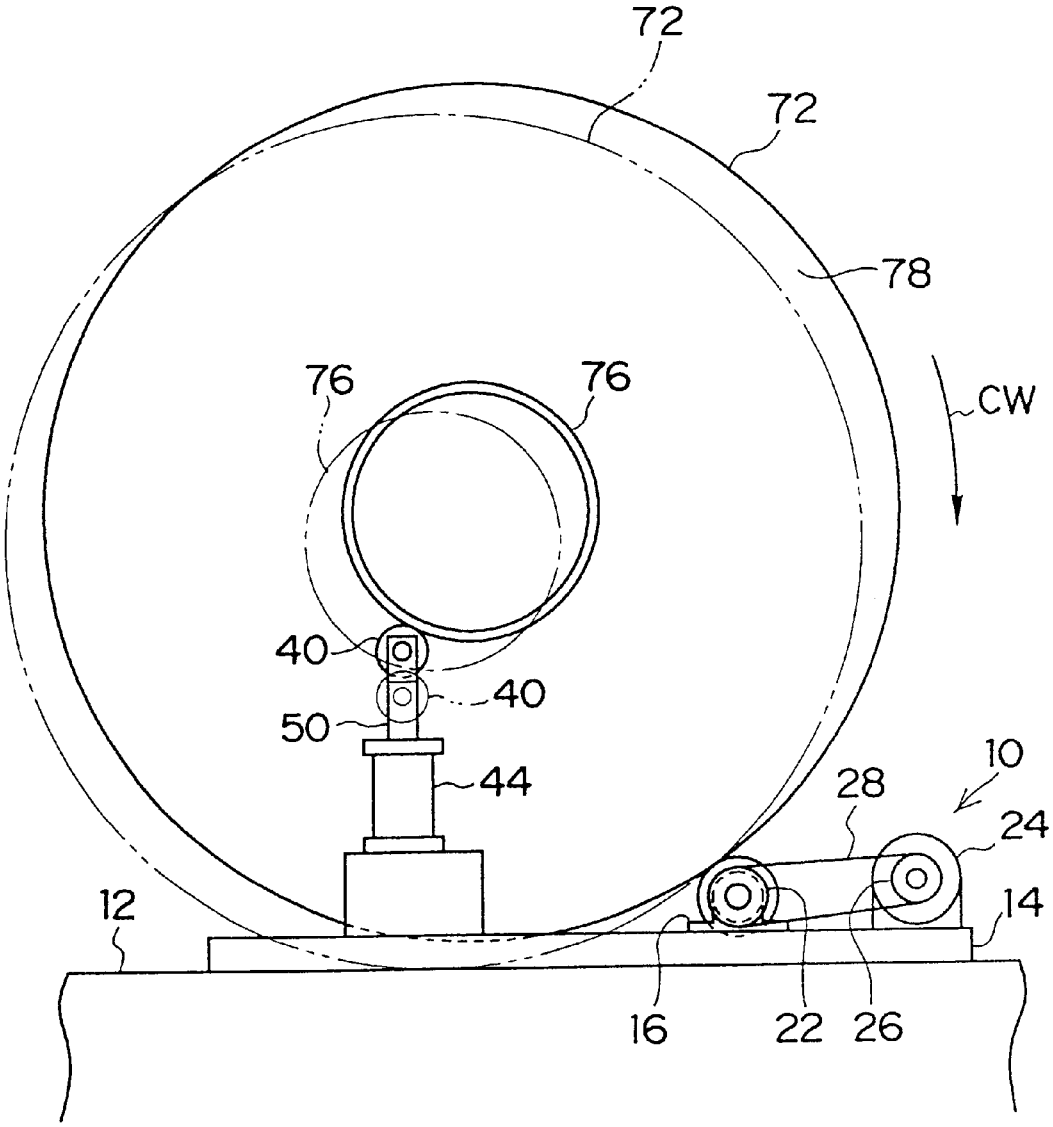
FIG. 9 is a side view of a device for storing an elongated plastically deformable member relating to a fourth embodiment of the present invention.
Figure 10:
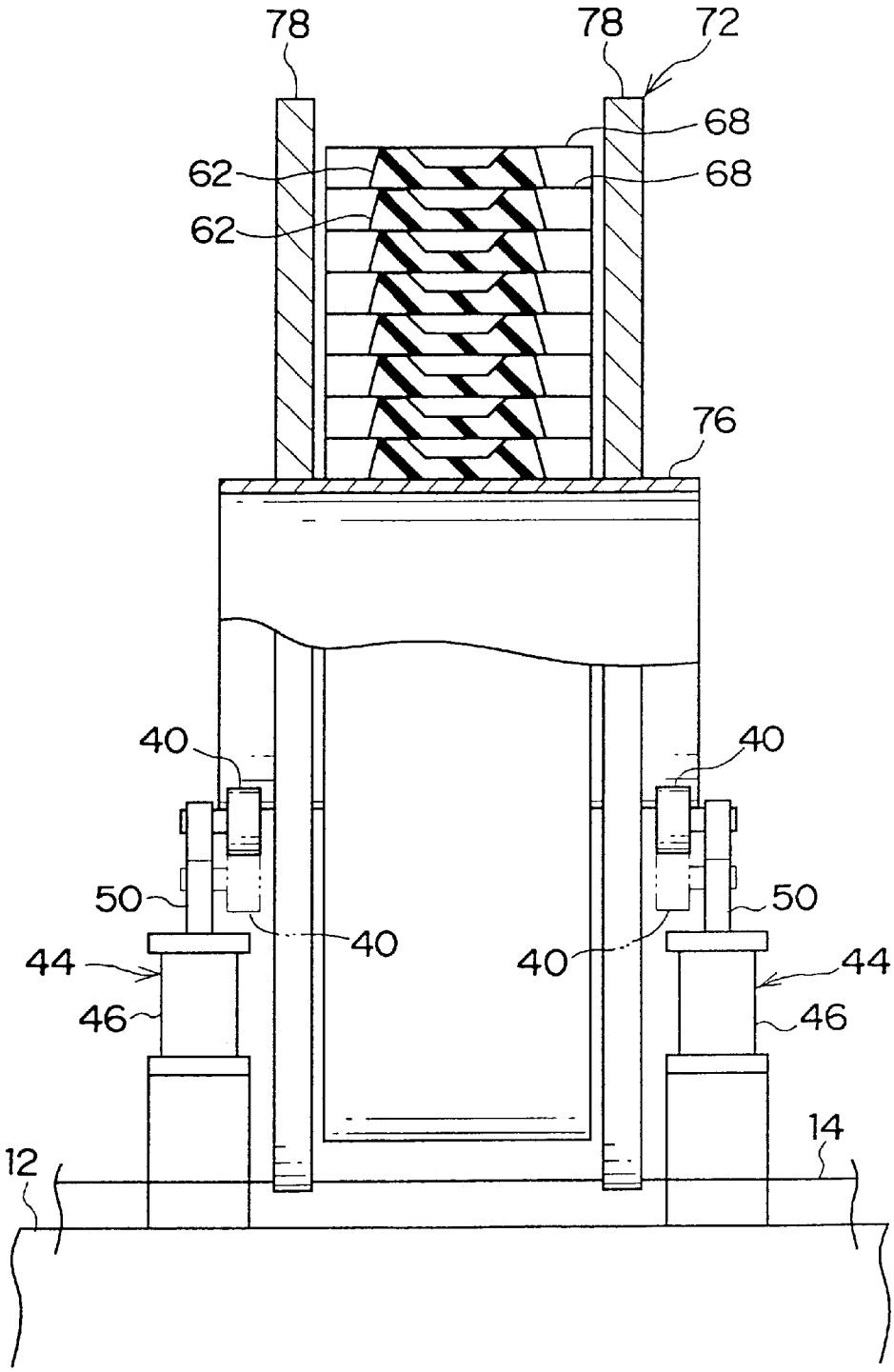
FIG. 10 is a front view of the device for storing an elongated plastically deformable member relating to the fourth embodiment of the present invention.

As illustrated in FIGS. 9 and 10, in the present embodiment, the air cylinders 44 are provided vertically on the setting surface 12.

In the present fourth embodiment, the shaft 38 at which the driven roller 40 is provided is fixed to the piston rods 50 of the air cylinders 44.

Next, operation of the storing device 10 of the present fourth embodiment will be described.

In the present fourth embodiment, first, as illustrated by the two-dot chain lines in FIG. 9, the piston rods 50 of the air cylinders 44 are withdrawn (the first state of the present invention), and the reel 72 is rolled and made to abut the drive roller 30.

Next, the piston rods 50 of the air cylinders 44 are protruded (the second state of the present invention).

In this way, the driven roller 40 abuts the drum 76, and as illustrated by the solid lines in FIG. 9, the reel 72 is raised up, moves apart from the setting surface 12, and is supported by the drive roller 30 and the driven roller 40.

Thereafter, in the same way as in the above-described embodiments, the reel 72 is rotated and stored.

The effects of the present fourth embodiment are the same as those of the previously-described embodiments.

In the above-described embodiments, an example is described in which the elongated plastically deformable member is a tread member of the tire. However, the present invention can be applied to any rubber product or intermediate member which is elongated and plastically deforms easily, such as a side rubber, an inner liner, a chafer, or the like.

Fifth Embodiment

A fifth embodiment of the present invention will be described hereinafter with reference to FIGS. 11 and 12. Structures which are the same as those of the above-described embodiments are denoted by the same reference numerals, and description thereof will be omitted.

Figure 11:
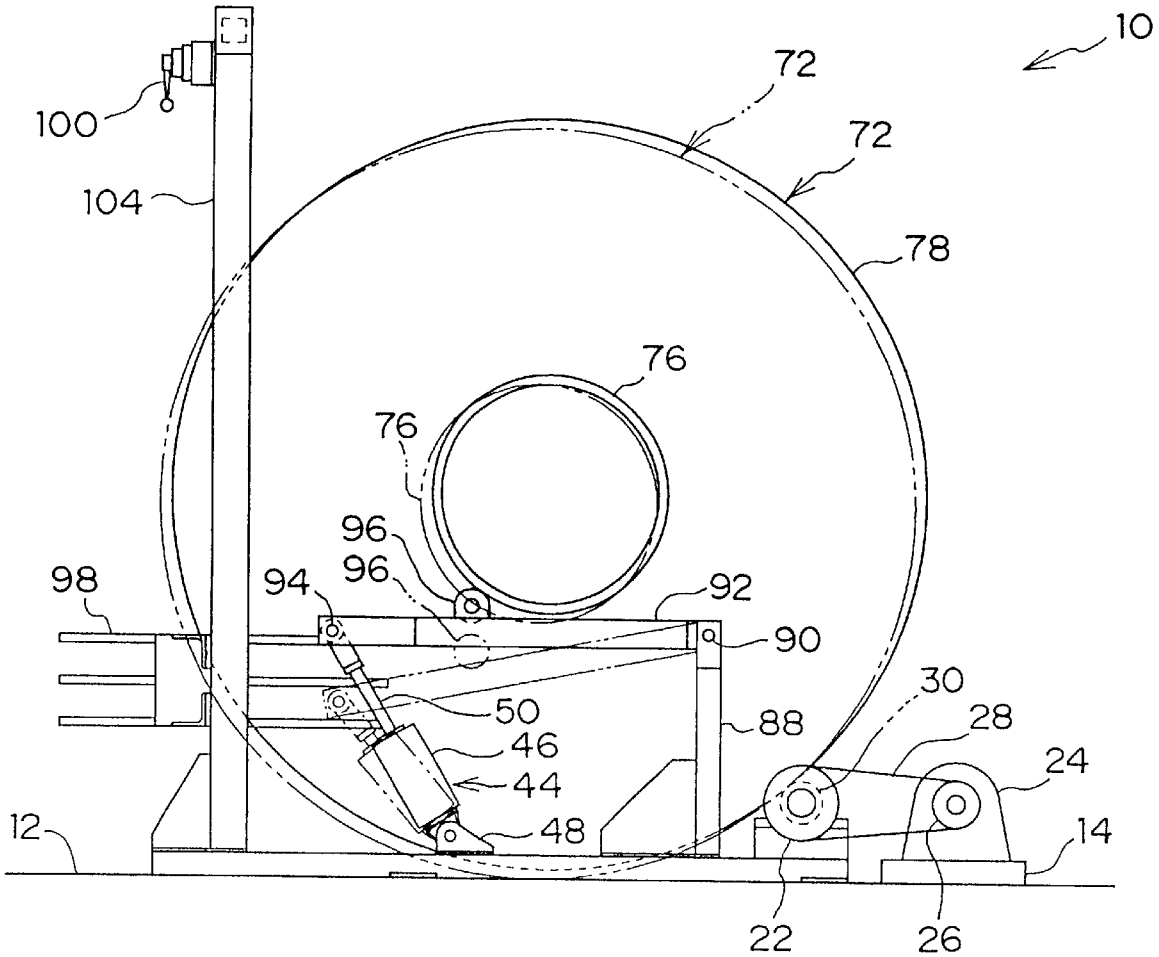
FIG. 11 is a side view of a device for storing an elongated plastically deformable member relating to a fifth embodiment of the present invention.
Figure 12:
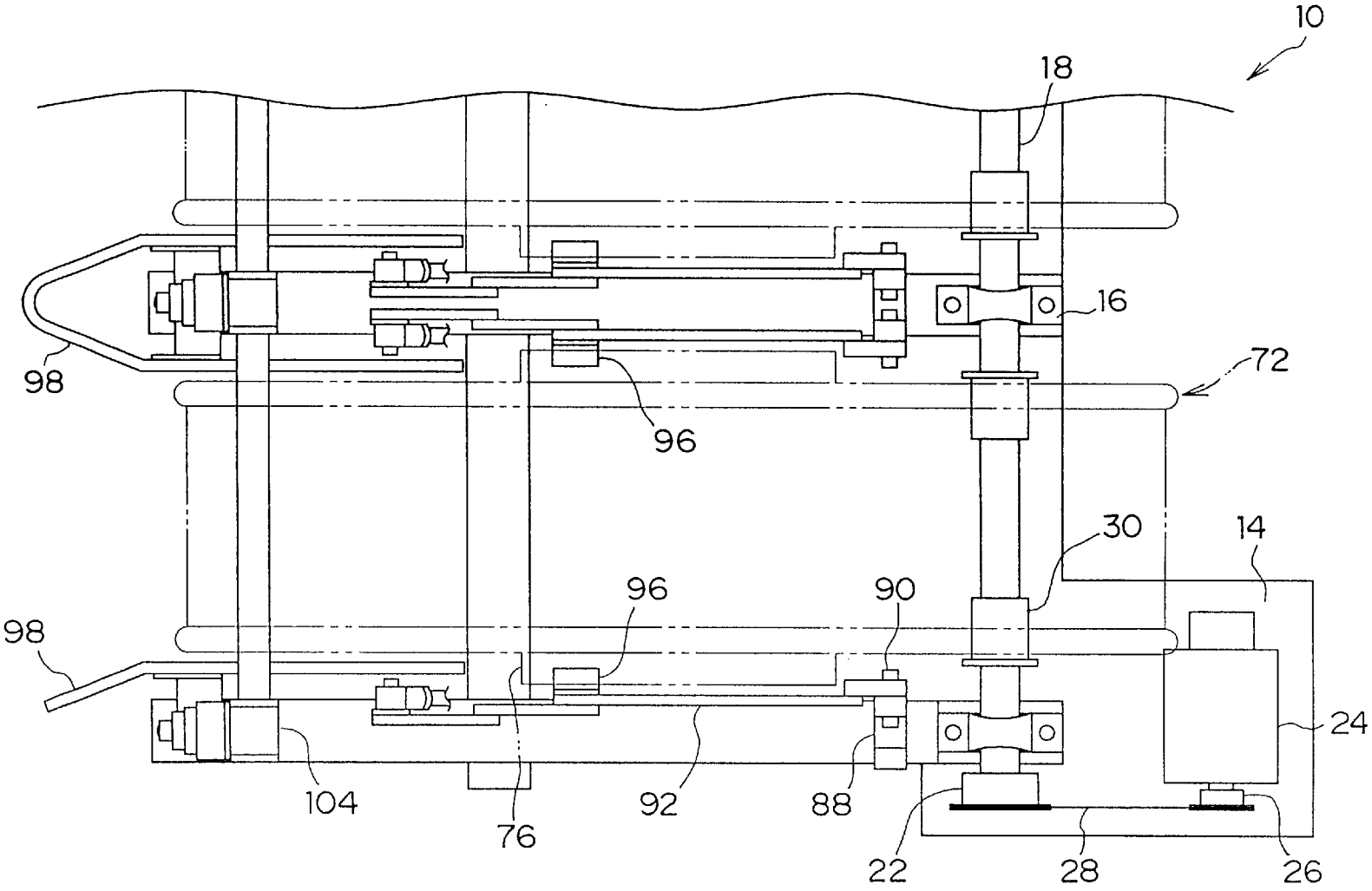
FIG. 12 is a plan view of the device for storing an elongated plastically deformable member relating to the fifth embodiment of the present invention.

As illustrated in FIGS. 11 and 12, supporting columns 88 are provided erect at the frame 14 in vicinities of the shaft supporting portions 16.

An arm 92 is swingably mounted, via a pin 90, to the upper portion of the supporting column 88.

The piston rod 50 of the air cylinder 44 is connected, via a pin 94, to the end portion of the arm 92 at the side opposite the pin 90 side.

A support roller 96, which supports the drum 76 of the reel 72, is provided at an intermediate portion of the arm 92.

An insertion guide 98 of the reel 72 is provided at the frame 14. A supporting column 104, to which an operation lever 100 of the air cylinder 44 is mounted, is provided at the frame 14.

Next, operation of the storing device 10 of the present embodiment will be described.

In the present fifth embodiment, first, as illustrated by the two-dot chain line in FIG. 11, the piston rods 50 of the air cylinders 44 are retracted so that the arms 92 are lowered, and the support rollers 96 are positioned lower than the bottom end of the drum 76 of the reel 72 (the first position of the present invention).

Next, the reel 72 is made to roll, and abuts the drive roller 30.

Subsequently, the piston rods 50 of the air cylinders 44 are extended, and the arms 92 are raised (the second position of the present invention).

In this way, the support rollers 96 abut the drum 76, and, as illustrated by the solid lines in FIG. 11, the reel 72 is raised. The reel 72 moves away from the setting surface 12 and is supported by the drive roller 30 and the support rollers 96.

Thereafter, in the same way as the previously-described embodiments, the reel 72 is rotated and stored.

The effects of the present embodiment are the same as those of the previously-described embodiments.

Sixth Embodiment

A sixth embodiment of the present invention will be described hereinafter with reference to FIGS. 13 and 14. Structures which are the same as those of the above-described embodiments are denoted by the same reference numerals, and description thereof will be omitted.

Figure 13:
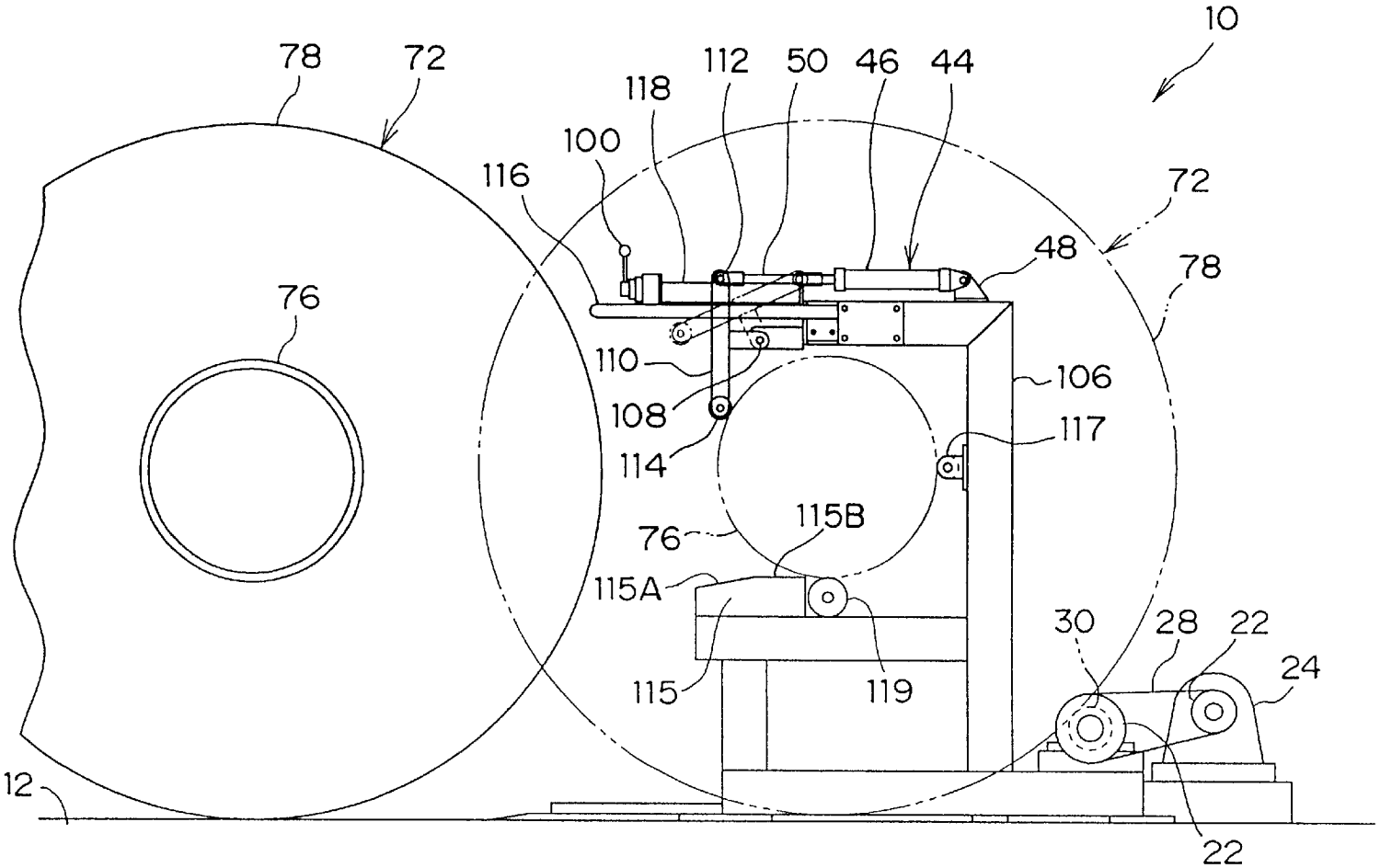
FIG. 13 is a side view of a device for storing an elongated plastically deformable member relating to a sixth embodiment of the present invention.
Figure 14:
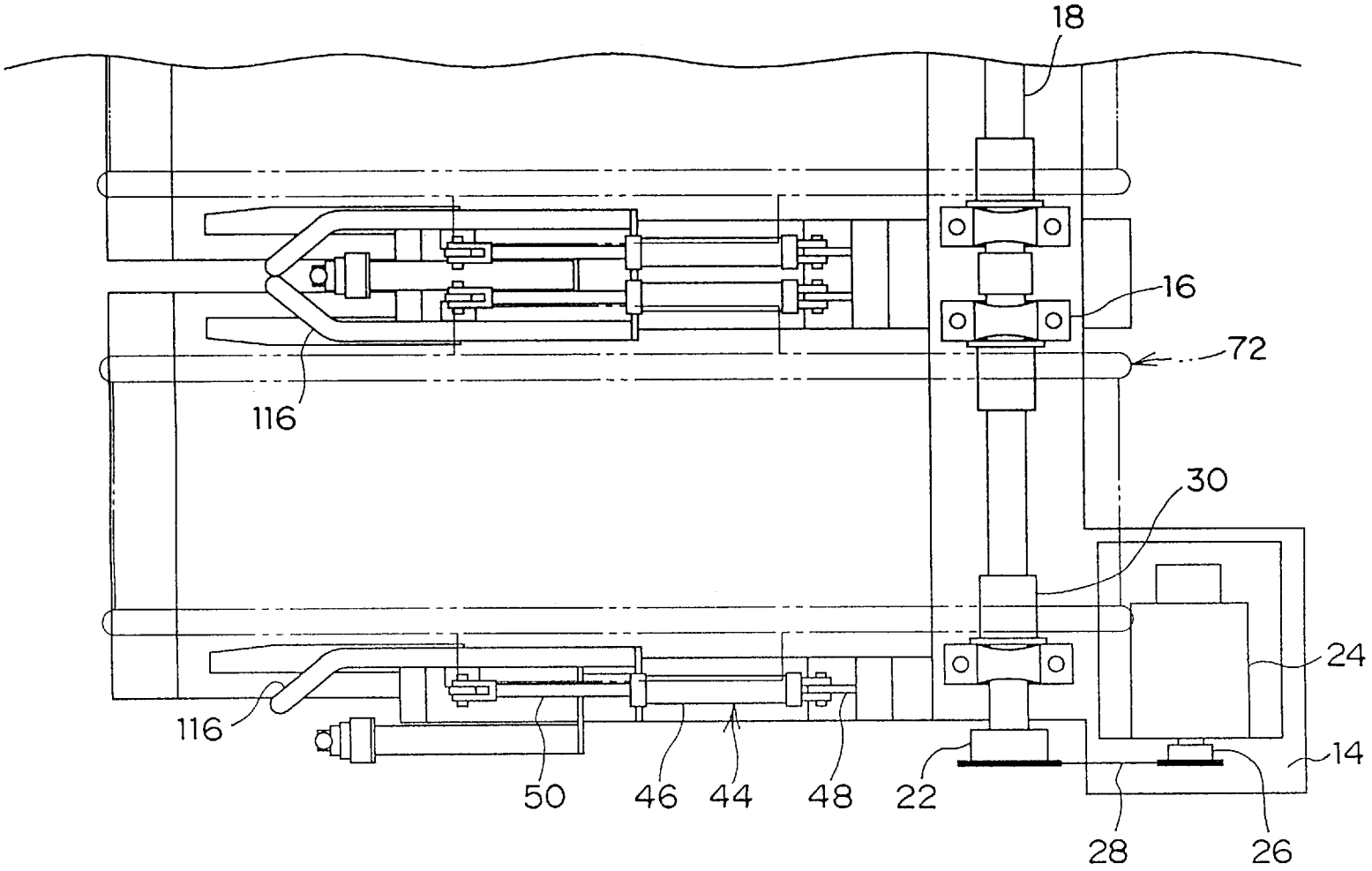
FIG. 14 is a plan view of the device for storing an elongated plastically deformable member relating to the sixth embodiment of the present invention.
Figure 15:
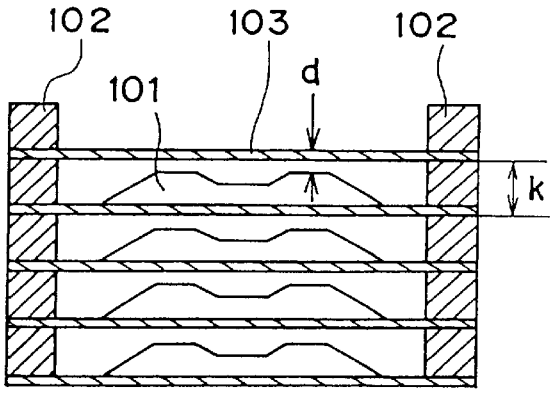
FIG. 15 is a schematic structural view of an elongated member storing device relating to a conventional example.
Figure 16:
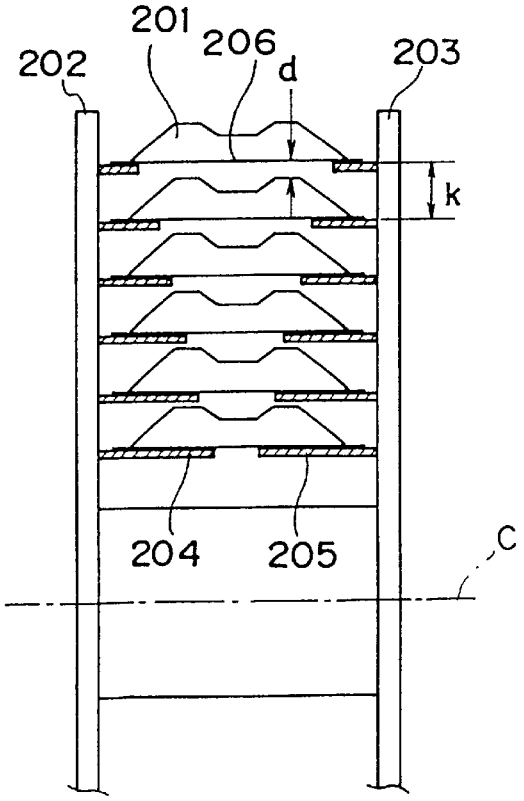
FIG. 16 is a schematic structural view of an elongated member storing device relating to another conventional example.

As illustrated in FIGS. 13 and 14, a supporting column 106 is provided so as to stand at the frame 14.

A T-shaped arm 110 is swingably mounted, via a pin 108, to the upper portion of the supporting column 106.

The piston rod 50 of the air cylinder 44 is connected, via a pin 112, to one end of the T-shaped arm 110.

A support roller 114, which supports the drum 76 of the reel 72, is provided at the other end portion of the T-shaped arm 110.

A taper guide 115 and a support roller 119, which support the drum 76 of the reel 72, are provided at the intermediate portion of the supporting column 106.

The taper guide 115 includes an inclined surface 115A and a horizontal surface 115B. When the drum 76 rolls on the horizontal surface 115B, the flanges 78 move apart from the setting surface 12.

Further, a support roller 117, which supports the drum 76 of the reel 72, is provided at the side surface of the supporting column 106.

An insertion guide 116 of the reel 72 is provided at the upper portion of the supporting column 106. An arm 118, to which the operation lever 100 of the air cylinder 44 is mounted, is provided at the upper portion of the supporting column 106.

Next, operation of the storing device 10 of the present embodiment will be explained.

In the present embodiment, first, as illustrated by the two-dot chain line in FIG. 13, the piston rods 50 of the air cylinders 44 are retracted, and the support rollers 114 of the T-shaped arms 110 are raised. The support rollers 114 are positioned above the top end of the drum 76 of the reel 72.

Next, the reel 72 is made to roll so that the drum 76 is set on the taper guides 115. The reel 72 is then rolled further so that the drum 76 set on the support rollers 119. The reel 72 thereby moves apart from the setting surface 12.

Next, the piston rods 50 of the air cylinders 44 are extended, the T-shaped arms 110 are rotated, and the support rollers 114 are made to abut the flanges 78.

In this way, in the state in which the reel 72 is separated from the setting surface 12, the reel 72 is supported by the support rollers 119, the support rollers 114, the support rollers 117 and the drive roller 30.

Thereafter, in the same way as in the previously-described embodiments, the reel 72 is rotated and stored.

The effects of the present embodiment are the same as those of the previously-described embodiments.

In the above-described fifth and sixth embodiments, a tire tread member is given as an example of the elongated plastically-deformable member. However, the present invention is applicable to any rubber product or intermediate member which is elongated and plastically deforms easily, such as a side rubber, an inner liner, a chafer, or the like.

As described above, in accordance with the device and method for storing an elongated plastically deformable member of the present invention, a take-up reel, on which an elongated plastically deformable member is wound, is stored while being rotated constantly or intermittently by a rotating means. Thus, the load caused by the wound elongated plastically deformable member itself can be applied uniformly to the entire wound circumference in accordance with the rotation of the take-up reel. Thus, local deformation of the elongated plastically deformable member, and non-uniform deformation in particular, can be prevented. Further, the elongated plastically deformable member is taken-up together with a liner onto the take-up reel. As the winding efficiency is improved and thus the device as a whole can be made simpler, the cost for manufacturing/maintaining the entire device can be reduced.

What is claimed is:

1. A method for storing an elongated plastically deformable member wound on a take-up reel together with a thin-plate-shaped liner superposed with the elongated plastically deformable member, the take-up reel having an axis which is disposed substantially horizontal with respect to a setting surface on which the take-up reel is set, comprising the step of rotating the take-up reel on which the liner and the elongated plastically deformable member have been wound at least one of constantly and intermittently so that collapsing deformation of the elongated plastically deformable member caused by the load of the member itself is made uniform along the entire longitudinal direction.

2. The method for storing an elongated plastically deformable member according to claim 1, further comprising the steps of:

(a) rotating the take-up reel an amount substantially equal to a given angle in a first direction;

(b) thereafter rotating the take-up reel an amount substantially equal to said given angle in the opposite direction; and (c) alternately repeating rotation of the take-up reel in said first and opposite directions until storage on the take-up reel is completed.

3. The method for storing an elongated plastically deformable member according to claim 2, further comprising the step of selecting the given angle from 180° and some integer multiple thereof.

4. The method for storing an elongated plastically deformable member according to claim 1, wherein the step of rotating the take-up reel at least one of constantly and intermittently includes the sub-steps of:

abutting the take-up reel against a first roller;

abutting another roller against the take-up reel spaced apart from the first roller;

supporting the take-up reel between the rollers; and rotating at least one of the rollers, thereby causing the take-up reel to rotate.

5. The method for storing an elongated plastically deformable member according to claim 4, wherein the step of abutting the take-up reel against a first roller includes the sub-step of withdrawing said another roller to a position wherein said another roller does not substantially interfere with movement of the take-up reel.

6. A device for use in storing an elongated plastically deformable member wound on a take-up reel with a thin-plate-shaped liner superposed with the elongated plastically deformable member, the take-up reel having an axis which is substantially horizontal, the device comprising a rotating mechanism adapted to rotate the take-up reel at least one of constantly and intermittently.

7. The device for use in storing an elongated plastically deformable member according to claim 6, wherein the rotating mechanism rotates the take-up reel over a given angle in a first direction of rotation, and thereafter, the rotating mechanism rotates the take-up reel in another direction, and alternately repeats rotating in said first direction and said another direction of rotation.

8. The device for use in storing an elongated plastically deformable member according to claim 7, wherein the given angle is substantially equal to an angle selected from the group consisting of 180° and an integer multiple of 180°.

9. The device for use in storing an elongated plastically deformable member according to claim 6, wherein the rotating mechanism includes a pair of rollers which abut the take-up reel when the rotating mechanism rotates the take-up reel.

10. The device for use in storing an elongated plastically deformable member according to claim 9, wherein the rotating mechanism includes a rotating driving member, and one roller of the pair of rollers is a drive roller connected to the rotating driving member, and another roller of the pair of rollers is a driven roller.

11. The device for use in storing an elongated plastically deformable member according to claim 10, further comprising a moving member connected to the driven roller so as to be able to move the driven roller from a first position to a second position, and when the driven roller is moved from the first position to the second position by the moving member, the take-up reel is raised up off of the setting surface by the driven roller and the drive roller.

12. The device for use in storing an elongated plastically deformable member according to claim 11, wherein the driven roller is removably connected to the moving member.

13. The device for use in storing an elongated plastically deformable member according to claim 11, wherein the drive roller is rotated by the rotation of the take-up reel when the take-up reel is raised up off of the setting surface by the driven roller and the drive roller.

14. A device for use in storing an elongated plastically deformable member which has been wound on a take-up reel along with a thin-plate-shaped liner superposed with the elongated plastically deformable member, the device comprising:

a pair of rollers which are provided so as to be able to abut and support the take-up reel, and a rotating driving member which drives and rotates one roller of the pair of rollers, wherein the other roller of the pair of rollers is movable from a first position to a second position, and when the other roller is positioned at the second position, the take-up reel is lifted and rotatably supported by the one roller and the other roller.

15. The device for use in storing an elongated plastically deformable member according to claim 14, further comprising a rotating mechanism which rotates the take-up reel in a first direction over a given angle, and thereafter, the rotating mechanism rotates the take-up reel in another direction, and alternately repeats rotating the take-up reel in said first and said another directions.

16. The device for use in storing an elongated plastically deformable member according to claim 15, wherein the given angle is substantially equal to one of 180° or some integer multiple thereof.

17. The device for use in storing an elongated plastically deformable member according to claim 14, wherein said other roller is a driven roller.

18. The device for use in storing an elongated plastically deformable member according to claim 14, further comprising a moving member connected to said other roller, wherein the moving member moves said other roller from the first position to the second position.

19. The device for use in storing an elongated plastically deformable member according to claim 18, wherein said other roller is removably connectable to the moving device.

* * * * *